United States Patent [19]

Vandeweghe et al.

[11] Patent Number: 4,791,967

[45] Date of Patent: Dec. 20, 1988

[54] DEVICE FOR DETERMINING THE LOCATION OF A WARP BREAK THREAD IN WEAVING LOOMS USING DROP WIRES

[75] Inventors: Michel Vandeweghe, Wijtschate-Heuvelland; Dirk Gryson, Dikkebus-Ieper, both of Belgium

[73] Assignee: Picanol N.V., Belgium

[21] Appl. No.: 14,778

[22] Filed: Feb. 13, 1987

[30] Foreign Application Priority Data

Feb. 14, 1986 [NL] Netherlands ..... 8600372

[51] Int. Cl.[4] ..... D03D 51/28

[52] U.S. Cl. ..... 139/353; 139/358; 66/163

[58] Field of Search ..... 139/336, 353, 354, 355, 139/356, 357, 358; 112/278; 66/163; 28/187

[56] References Cited

U.S. PATENT DOCUMENTS

| | | | |
|---|---|---|---|
| 2,512,165 | 6/1950 | Meier . | |
| 2,834,381 | 5/1958 | Grangier . | |
| 3,725,911 | 4/1973 | Cook et al. . | |
| 3,902,534 | 9/1975 | Nishiguchi et al. | 139/353 |
| 4,321,951 | 3/1982 | Hintsch | 139/353 |
| 4,522,236 | 6/1985 | Lohr | 139/353 |

FOREIGN PATENT DOCUMENTS

| | | |
|---|---|---|
| 801920 | 12/1950 | Fed. Rep. of Germany . |
| 1535597 | 12/1970 | Fed. Rep. of Germany . |
| 708306 | 7/1931 | France . |
| 982218 | 6/1951 | France . |
| 60-81355 | 5/1985 | Japan . |

*Primary Examiner*—Henry S. Jaudon

*Attorney, Agent, or Firm*—Bacon & Thomas

[57] ABSTRACT

An apparatus for determining the location of a warp thread break in weaving looms using drop wires, including detection devices 6 to identify warp thread breaks, movable drop wire locators 7 to determine the warp thread break locations, switching devices 8 arranged to actuate the drop wire locators 7, causing the drop wire locators to move until a fallen drop wire is encountered, and indicators on the drop wire locators to indicate the position of the drop wire locator along the warp threads.

13 Claims, 2 Drawing Sheets

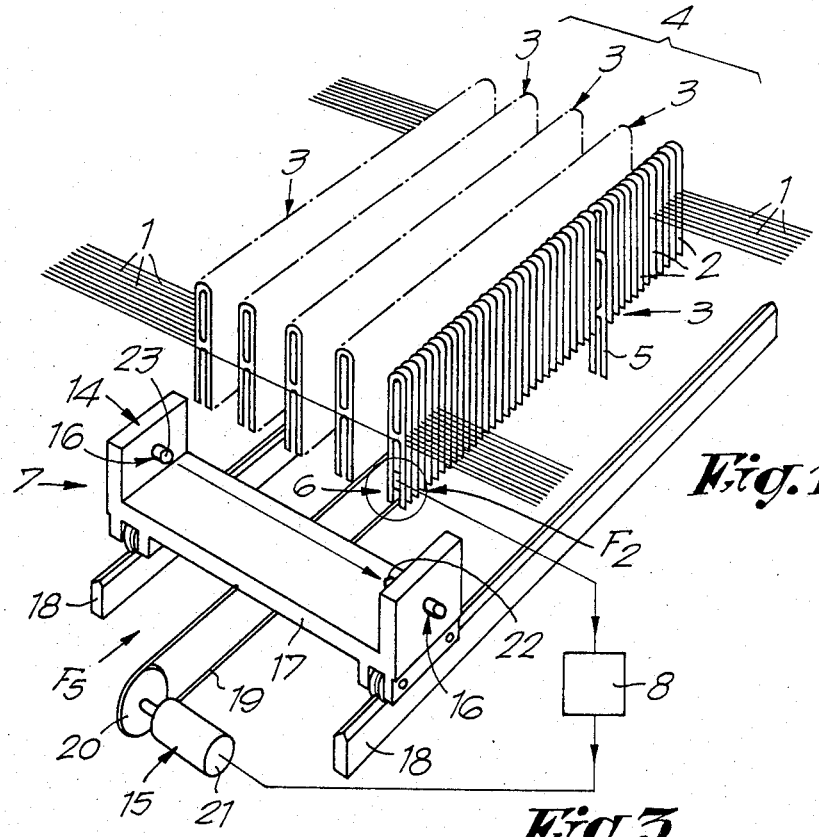
Fig. 1
Fig. 3
Fig. 2
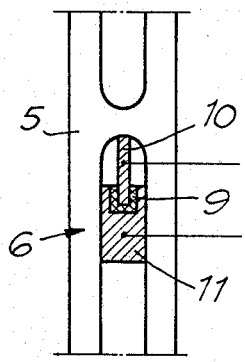
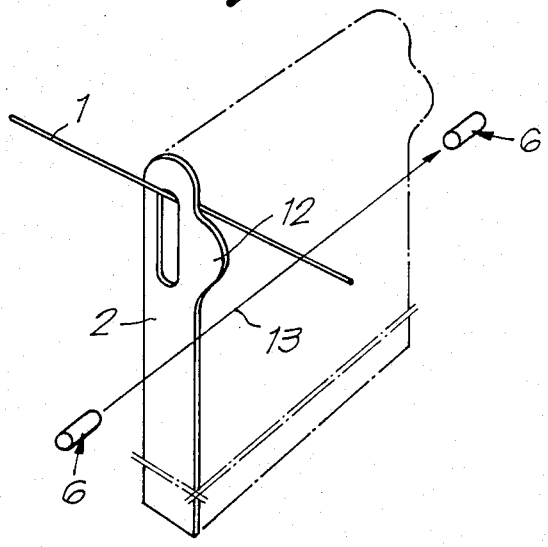

DEVICE FOR DETERMINING THE LOCATION OF A WARP BREAK THREAD IN WEAVING LOOMS USING DROP WIRES

BACKGROUND OF THE INVENTION

This invention concerns a device for the determination of the location of a warp thread break in weaving looms using drop wires.

In conventional warp thread control systems, the use of a drop wire to locate warp thread breaks is already well known. In such a system, a drop wire is associated with each warp thread in such a way that, in case of a break of a warp thread, the corresponding drop wire is caused to fall downwards onto an electrode common to all the drop wires, whereby an electrical circuit is closed resulting, finally, in stopping the weaving loom. According to an alternative solution described by the French Pat. No. 982,218 and the German Pat. No. 801,920, the detection of a fallen drop wire is achieved by means of one or several photo-electric elements. Because of the large density of the warp threads, i.e., 40 to 60 threads per centimenter, it is quite obvious that the pack of drop wires associated with the threads is very dense and compact. In order to facilitate the associating of each warp thread with a drop wire, the drop wires are distributed in five to six rows across the warp threads. Quite obviously, such a large pack of steel drop wires constitute a non-transparent system in which it is quite difficult to look through to the underside of the five to six rows of drop wires because sight is obstructed by the plane constituted by the warp threads. This type of installation has the disadvantage that, while the repair of a warp thread break is carried out, 30 to 50% of the time required for the repair is spent on detecting the fallen drop wire. The machine operator of the loom must leave his station in order to look under the drop wire pack and manually determine the exact location of the fallen drop wires.

A known solution permitting a quicker location determination of the fallen drop wires is disclosed in German Pat. No. DOS 1,535,597, whereby the drop wires or other contact elements completely fall out of the pack of drop wires and are collected ina relatively well visible gutter. In such an installation the location of the broken warp thread is indicated relatively well, but it has the disadvantage that it is quite difficult to exactly determine the location where the drop wire, which has completely fallen out of the drop wire pack, must be picked up. Errors are thus by no means eliminated in this system.

The second known solution of the problem of location determination of a warp thread break involves the distribution of contact electrodes for all the drop wires into zones whereby, by means of a warning lamp, a zone where a fallen drop wire is present can be indicated. In this system, the disadvantage of the necessary manual search is still present.

According to a third solution of the problem as suggested by U.S. Pat. No. 3,725,911 and by Japanese Pat. No. 60-81355, the zones could be still further subdivided, and each drop wire could be associated with an electrode or a contact element or similar system with a corresponding indication element. Bearing in mind the large number of fine electrodes which would be required in such a system, this solution would be a very expensive and unpractical one. Additionally, contacts of this kind are quickly contaminated by dust present in the weaving loom.

SUMMARY OF THE INVENTION

The object of this invention is thus to propose a device for determining the location of a warp thread break without the disadvantages such as those mentioned and others. The device in accordance with the invention has the advantage that a fallen warp thread can be very quickly and automatically detected and that its location can then be directly made visible in such a way that the weaver is no longer obliged to search for the fallen thread.

To this end the device for determining the location of a warp thread break according to the invention is mainly composed of known detection devices which detect warp thread breaks, drop wire locators which determine the location of the warp thread breaks, and of switching means which actuate the dropped wire locators that are controlled by the detection devices mentioned above. According to the preferable embodiment, the dropped wire locators are mainly composed of a movable detection device which moves along the rows of drop wires. The detection device is put into operation only if a drop wire has fallen, and is automatically stopped at the place where the fallen drop wire is located.

According to an alternative embodiment, the fallen drop wire is isolated from the surronding drop wires, i.e., it is shown to the weaver in such a way that he can easily locate and carry out the repair of the broken warp thread.

BRIEF DESCRIPTION OF THE DRAWINGS

In order that the characteristics of the invention may be better understood, preferable embodiments are described hereinafter with reference to the figures and by way of examples not intended to limit the scope of the invention wherein:

FIG. 1 is a schematic view of the installation according to the invention.

FIG. 2 is a view of the detection devices indicated by F2 in FIG. 1, at a larger scale.

FIG. 3 is a view of an alternative embodiment of the detection device of FIG. 2.

DESCRIPTION OF THE PREFERRED EMBODIMENTS

Figure 4:
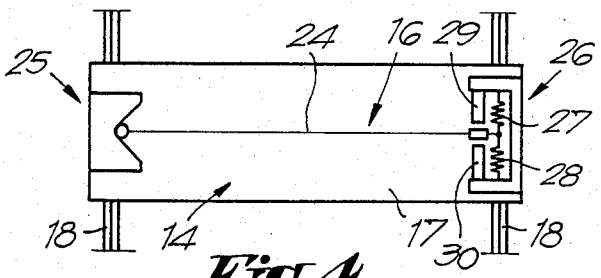
FIG. 4 is a top view of a possible embodiment of the movable detection installation which may be used in the present invention.

As illustrated in FIG. 1, the warp threads of a weaving loom are equipped with suspended drop wires 2 which are disposed in rows 3 and form compact drop wire packs. When a warp thread is broken, the drop wire pack 4 will include a drop wire 5 which has fallen downwards. The invention concerns a device for determining the location of such fallen drop wires 5. The device, as schematically illustrated by FIG. 1, is mainly composed of the combination of already known detection devices 6 in order to detect the warp thread break, of drop wire locators 7 in order to determine the warp thread break location, and of switching devices 8 which operate to actuate the drop wire locators 7 which are controlled by the previously mentioned detection devices 6.

The detection devices 6, which detect whether one or several drop wires 5 fall out of the drop wire pack 4, are already known in the art and may be of various kinds. FIGS. 2 and 3 illustrate two possible embodiments of these devices. According to the embodiment of FIG. 2, use is made of two electrodes 10 and 11 which are secured together by means of an insulation layer 9. The electrodes, on the one hand, serve as a mechanical guide for the drop wires 2 and, on the other hand, are bridged forming an electrical connection between the electrodes 10 and 11 when a drop wire has fallen, as illustrated in the figure. When the electrical connection is made between the electrodes, the switching devices 8 will be actuated to generate a broken warp electrical signal.

According to an alternative embodiment illustrated in FIG. 3, the drop wires 2 are equipped with lips 12 in such a way that, if a drop wire 2 falls and interrupts a light ray 13 from a photo-electric circuit, the switching devices 8 will be actuated.

The drop wire locators 7 are mainly composed of a detection device 14 which is movable along a locator path along the rows 3 of drop wires transverse to the warp threads, the detection device being composed of a guided supporting element, an actuating system 15, and at least one detector 16 fastened on the supporting element. The guided supporting element is composed, according to the illustrated embodiment, of a trolley 17 which can be moved on a track 18 extending along the locator path. The actuating system 15 is composed of a movable cable 19 which is connected to the trolley 17 and which is guided on both sides of the weaving loom over cable pulleys 20, with at least one of these cable pulleys 20 being driven by an electric motor 21.

According to the embodiment of FIG. 1, the dropped wire detector 16 is composed of a photo-electric cell 22 and a light source 23. The trolley 17 is situated in such a way that it can be moved back and forth along the track 18 and reciprocated along the full weaving width of the loom under the drop wire pack 4. The detector 16 is designed in such a way that it can only detect the fallen drop wires 5 as the trolley 17 passes by them to generate a dropped wire location signal.

Quite obviously, the detector 16 may be of any advisable kind known in the art. For the sake of better understanding, FIG. 4 illustrates a further embodiment whereby the detector 16 is mainly composed of an electro-mechanical contact element 24 which is pivotally mounted at one end 25 of the trolley 17, and is held between two electrical contacts 29 and 30 near the other end 26 of the trolley 17 by means of the springs 27 and 28. If, during the displacement of the trolley 17, the contact element 24 contacts a fallen drop wire 5, the contact element 24 will be displaced and establish an electrical circuit through the contact element 24 and one of the contacts 29 or 30 to generate a dropped wire location signal.

According to still another embodiment, the detector 16 may be composed of an inductive or capacitive proximity switch.

The previously described drop wire locators 7 are preferably equipped with a switching off element, (not illustrated in the figures) which is controlled by the detector 16 already mentioned in such a way that, as soon as the detector of the trolley 17 comes into contact with a fallen drop wire 5, its actuation system 15 is stopped by this switching off element thereby stopping the movement of the trolley.

Moreover, the invention also includes an indication means which indicates the location of the detector 16 of the movable support element. According to a first alternative embodiment, the indication means may be composed of a lamp or an indicator which is moved, for instance, below the plane formed by the warp threads simultaneously with the motion of the trolley 17. The indications means are preferably mounted on the movable detection device 14 or on the trolley 17 itself.

Figure 5:
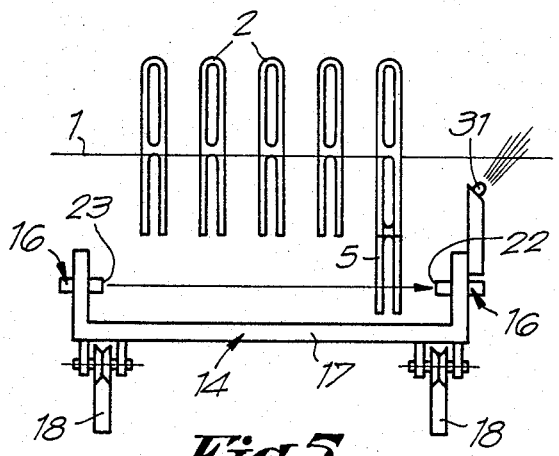
FIG. 5 is a view of an alternative embodiment of the movable detection installation which may be used in the present invention.

As illustrated by FIG. 5, one embodiment of the indication means is composed of a lamp 31 which is fastened on the trolley 17 in such a way that it is located immediately under the warp threads. In this way it becomes possible to see very easily through the warp threads 1 where the trolley 17 is located. The lamp 31 may be continuously switched on during the motion of the trolley 17, or may also be switched on only at the moment the trolley 17 has come across a fallen drop wire 5 and has stopped moving.

Figure 6:
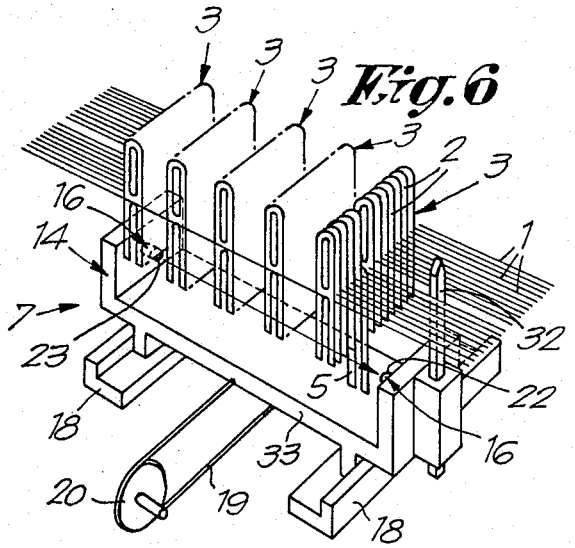
FIG. 6 is a perspective view of still another alternative embodiment of the movable detection installation.

In the embodiment according to FIG. 6, use is made of indication means composed of an indicator 32 which, when the movable detection device 14 detects a fallen drop wire 5 and is immobilized, the indicator 32 is raised upward far enough to protrude out of the plane composed of the warp threads. Quite obviously, this indicator 32 may also be equipped with a lamp. As also illustrated by FIG. 6, the support element does not necessarily have to be a trolley 17 but may also be made of a sliding carriage 33 or similar device.

The functioning of the device according to the invention as described above can easily be understood by referring to the drawing figures. Essentially, at the moment that the detection devices 6 detect that a fallen drop wire 5 is present, the switching devices 8 are actuated in such a way that the actuating system 15 is switched on, whereby the movable detection device 14 underneath the drop wire pack 4 begins to move. At the moment that the detector 16 identifies the fallen drop wire 5, the actuating system 15 is switched off, the movement of the detection device stops, and the indication devices previously described are switched on. The operator can then easily perceive the location of the fallen drop wire 5 and carry out the repair of the broken warp thread.

In an at rest condition, the movable detection device 14 will always be located adjacent to, but completely outside the drop wire pack 4.

Figure 7:
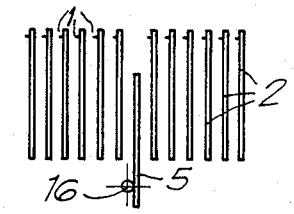
FIGS. 7–10 are schematic representations of the functioning of a presentation mechanism which may be used in the present invention.
Figure 7:
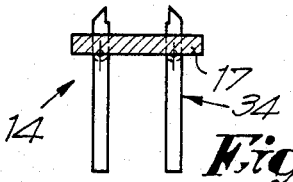
Figure 8:
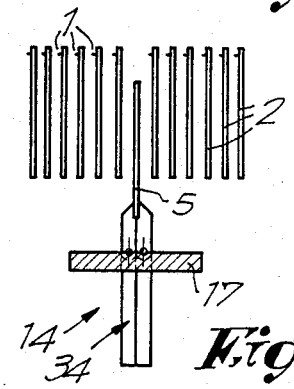
Figure 9:
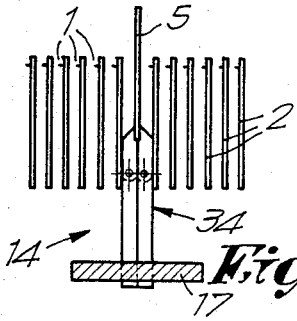
Figure 10:
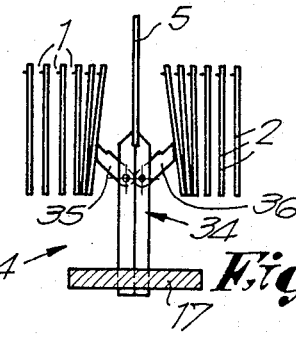

According to still another alternative embodiment of the installation described hereabove, the indication devices already described may also include a presentation mechanism which is schematically illustrated in FIGS. 7–10. This presentation mechanism is mainly composed of, as illustrated in FIG. 7, a gripper 34 or similar element which is mounted on a support element described above, such as the trolley 17 or the sliding carriage 33. In the case illustrated in FIG. 7, when the detector 16 identifies a fallen drop wire 5, the gripper 34 along with the trolley 17 is stopped immediately under this drop wire 5. As illustrated in FIGS. 8 and 9, the drop wire 5 is gripped by the gripper 34 and then pushed upwards in such a way that this drop wire appears above the drop wire pack 4. As illustrated in FIG. 10, the presentation mechanism may also be equipped with a separation mechanism in order to push off to the sides the drop wires 2 which are located on the left and right sides of the gripped drop wire 5. In this way, the isolated drop wire 5 is located completely outside the drop wire pack 4. Direct access by hand is thus made possible in order to repair the broken warp thread. The separation mechanism may be also composed, as schematically illustrated in FIG. 10, of two arms 35 and 36 which can rotate out from the side of the gripper 34 and push the drop wire pack 4 back to provide an opening in the drop wire pack at the location of the broken warp thread.

According to another embodiment, which is not illustrated in the figures, the separation mechanism may also be composed of separation elements which may be automatically located near a gripper 34 on the left and right sides as described hereafter. The gripper 34 first grips the fallen drop wire 5. Then the gripper is moved, for instance, by a small movement of the trolley 17 or the sliding carriage 33—for instance, to the left hand side and thereby pushes away the suspended drop wires 2 on the left hand side of the fallen drop wire 5. In the space created in this way, a suitable mechanism pushes upwards a first separation element. Afterwards, the whole system is slightly moved to the right hand side while a second separation element is pushed up in the space created now on the right hand side near the gripper. Finally, both separation elements are moved as far as possible away from each other. The fallen drop wire 5 can now be pushed free and upwards, becoming easily visible.

Quite obviously the presentation mechanism described hereabove may have one or several grippers 43 or similar elements. According to the first embodiment, one gripper 34 is provided for each row of drop wires 3. According to another embodiment, one or several grippers 34 are mounted on the trolley 17 for movement in a direction transverse to the displacement direction of the trolley 17. In this way each gripper may associate itself with two or more rows of drop wires 3. The actuation of the appropriate gripper and/or the degree of the transverse displacement of one of the grippers is controlled, for instance, by the detection device 6 described above.

A fallen drop wire 5 which is freely visible, as explained above, is of special interest because an automatic device may be used for repairing the broken warp thread. This is possible because the fallen drop wire 5 is now easily accessible, not only by hand but also with relatively bulky mechanisms.

This invention is by no means limited to the embodiments described by way of example and contained in the drawings, but it is also a device for determining the location of a warp thread break in weaving looms of any design and size with warp thread control drop wires which can be put into practice without leaving the scope of the invention.

We claim:

1. An apparatus for electrically detecting and locating a broken warp thread in a weaving loom including a plurality of drop wires arranged to be associated with the warp threads of a loom so that, upon loss of tension in a warp thread due to breakage a drop wire drops from a normal high to a low position, comprising:

means for generating a broken warp electrical signal when a drop wire drops to a low position;

a movable drop wire locator arranged to traverse a locator path adjacent said drop wires;

means for moving said locator along its locator path in response to said broken warp electrical signal;

means associated with the locator for detecting and indicating the position of the drop wire.

2. The apparatus as claimed in claim 1, including means for stopping the motion of the locator upon its reaching a position correlated with the drop wire position.

3. The apparatus as claimed in claim 2, wherein said locator is arranged to traverse a locator path beneath the drop wires and extending transversely of the warp threads.

4. The apparatus as claimed in claim 2, said means for detecting the position of the drop wire including an electrical sensing means for generating a dropped wire location signal; said means for stopping the motion of the locator arranged to receive said dropped wire location signal and to stop the locator motion in response thereto.

5. The apparatus as claimed in claim 2, wherein said means for indicating the dropped wire position is disposed on the locator.

6. The apparatus as claimed in claim 5, wherein the indicating means comprises a signal lamp.

7. The apparatus as claimed in claim 5, wherein the indicating means comprises a visible position marker.

8. The apparatus as claimed in claim 7, wherein the marker is arranged to be moved from a normal low position beneath the warp thread plane to a marking position above the warp thread plane when the locator motion stops in response to detecting a dropped wire position.

9. The apparatus as claimed in claim 8, said indicating means including means for raising the dropped wire upwardly above its normal high position upon the stopping of the motion of the locator.

10. The apparatus as claimed in claim 9, including means for spreading apart dropped wires adjacent to the dropped wire upon raising of the dropped wire.

11. The apparatus as claimed in claim 2, wherein said means for moving the locator comprises an electrical actuator; said means for stopping the locator motion comprising switch means for interrupting energization of said actuator.

12. The apparatus as claimed in claim 11, said switch means comprising a proximity switch located on the locator and actuated by contact with a dropped wire.

13. The apparatus as claimed in claim 11, said switch means comprising an optical sensor mounted on the locator and actuated in response to optical detection of the presence of a dropped wire.

* * * * *